US008833381B2

(12) United States Patent
Moore

(10) Patent No.: US 8,833,381 B2
(45) Date of Patent: Sep. 16, 2014

(54) DECORATING TIP CLEANING APPARATUS

(76) Inventor: James R. Moore, Milton, PA (US)

( * ) Notice: Subject to any disclaimer, the term of this patent is extended or adjusted under 35 U.S.C. 154(b) by 85 days.

(21) Appl. No.: 13/484,325

(22) Filed: May 31, 2012

(65) Prior Publication Data

US 2013/0318736 A1 Dec. 5, 2013

(51) Int. Cl.
*B08B 3/12* (2006.01)
*B08B 6/00* (2006.01)

(52) U.S. Cl.
USPC ..... 134/201

(58) Field of Classification Search
None
See application file for complete search history.

(56) References Cited

U.S. PATENT DOCUMENTS

| | | | |
|---|---|---|---|
| 1,091,877 | A | 3/1914 | Collis |
| 4,718,441 | A | 1/1988 | Daum et al. |
| D532,654 | S | 11/2006 | Raichlen et al. |
| D609,525 | S | 2/2010 | Rabanal |
| D614,003 | S | 4/2010 | Zemel |

*Primary Examiner* — Jason Ko
(74) *Attorney, Agent, or Firm* — Dale J. Ream

(57) ABSTRACT

A decorating tip cleaning apparatus includes a first frame member having opposed front and rear edges and a second frame member having opposed front and rear edges. The rear edges of the frame members are pivotally coupled together such that the first and the second frame members are movable between a closed configuration at which the front edges, respectively, are generally adjacent one another and an open configuration at which the front edges, respectively, are separated from one another. The first and second frame members include a mesh material extending between respective front and rear edges. The mesh material of the first frame member defines a plurality of apertures spaced apart from one another, each aperture being configured to receive a decorating tip partially therethrough. Each aperture is configured to receive only a portion of a respective decorating tip.

11 Claims, 5 Drawing Sheets

DECORATING TIP CLEANING APPARATUS

BACKGROUND OF THE INVENTION

This invention relates generally to cleaning devices and, more particularly, to an apparatus configured to secure decorating tips of varied sizes for cleaning by spraying, washing, or dishwasher cleaning.

Cake decorators utilize a variety of decorating tips to decorate cakes, cupcakes, and other pastries. Cleaning multiple decorating tips is a time consuming, inconvenient, and generally undesirable task that must be undertaken between usages of the tips. A significant difficulty with cleaning the tips is that they must be washed individually by hand or at least held individually while spraying them with a sink sprayer.

Various devices have been proposed in the art for holding articles to be washed, such as baskets for holding baby bottle nipples, baskets configured to hold grill accessories, and the like. Although assumably effective for their intended purposes, the existing and proposed devices do not effectively hold decorating tips apart from one another and in an extended position to be sprayed or cleaned effectively.

Therefore, it would be desirable to have a decorating tip cleaning apparatus for holding and situating a plurality of decorating tips for cleaning. Further, it would be desirable to have a decorating tip cleaning apparatus that enables decorating tips to be inserted into a plurality of complementary apertures and that includes handles by which to hold the apparatus during cleaning.

SUMMARY OF THE INVENTION

A decorating tip cleaning apparatus for securing decorating tips for cleaning according to the present invention includes a first frame member having opposed front and rear edges and a second frame member having opposed front and rear edges. The rear edges of the frame members are pivotally coupled together such that the first and the second frame members are movable between a closed configuration at which the front edges, respectively, are generally adjacent one another and an open configuration at which the front edges, respectively, are separated from one another. The first and second frame members include a mesh material extending between respective front and rear edges. The mesh material of the first frame member defines a plurality of apertures spaced apart from one another, each aperture being configured to receive a decorating tip partially therethrough. Each aperture is configured to receive only a portion of a respective decorating tip such that the respective decorating tip is prevented from falling from the first frame member.

Therefore, a general object of this invention is to provide a decorating tip cleaning apparatus for securing decorating tips for cleaning.

Another object of this invention is to provide a decorating tip cleaning apparatus, as aforesaid, having frame members configured to sandwich inserted decorating tips and hold them securely while being cleaned.

Still another object of this invention is to provide a decorating tip cleaning apparatus, as aforesaid, that may be carried and held by handles while the inserted decorating tips are cleaned.

Yet another object of this invention is to provide a decorating tip cleaning apparatus, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
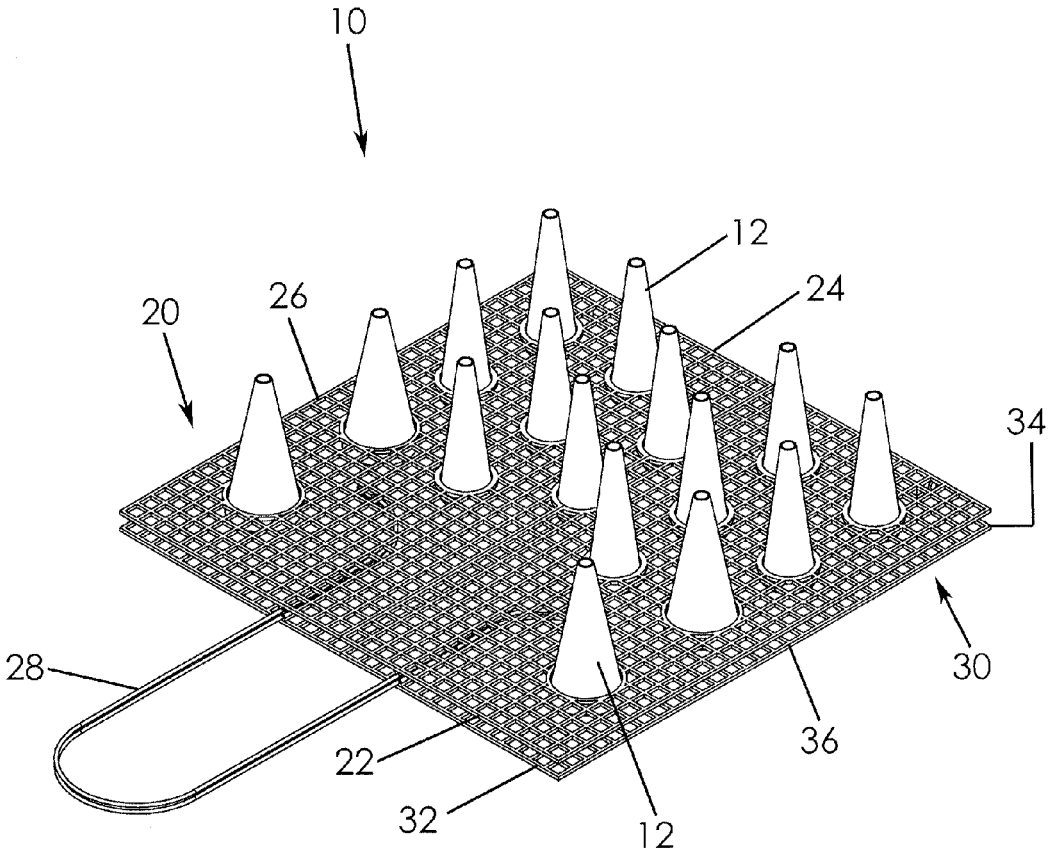
FIG. 1 is a perspective view of a decorating tip cleaning apparatus according to a preferred embodiment of the present invention illustrated in a closed configuration.
Figure 2:
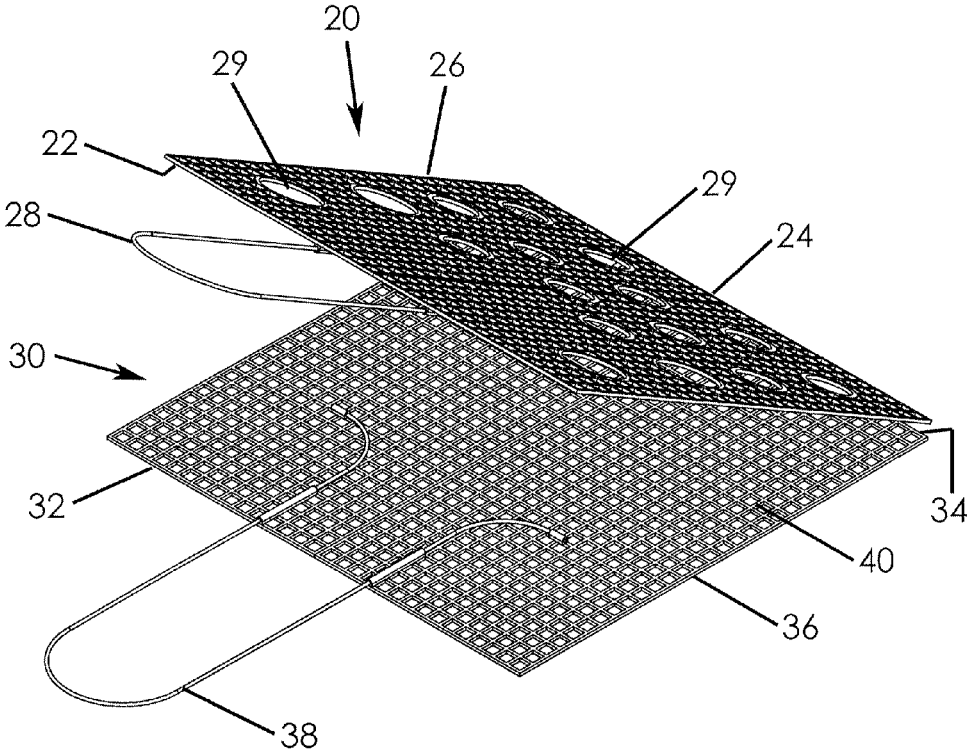
FIG. 2 is a perspective view of the cleaning apparatus as in FIG. 1 illustrated in an open configuration.
Figure 3:
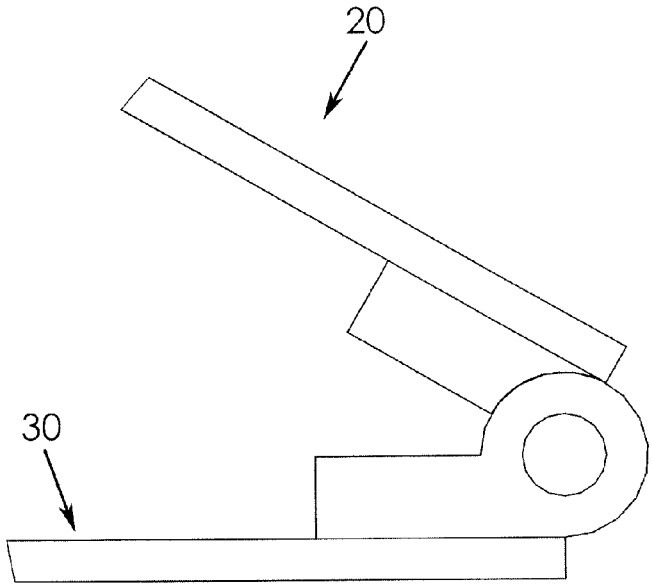
FIG. 3 is a side view on an enlarged scale of the cleaning apparatus as in FIG. 2.
Figure 4:
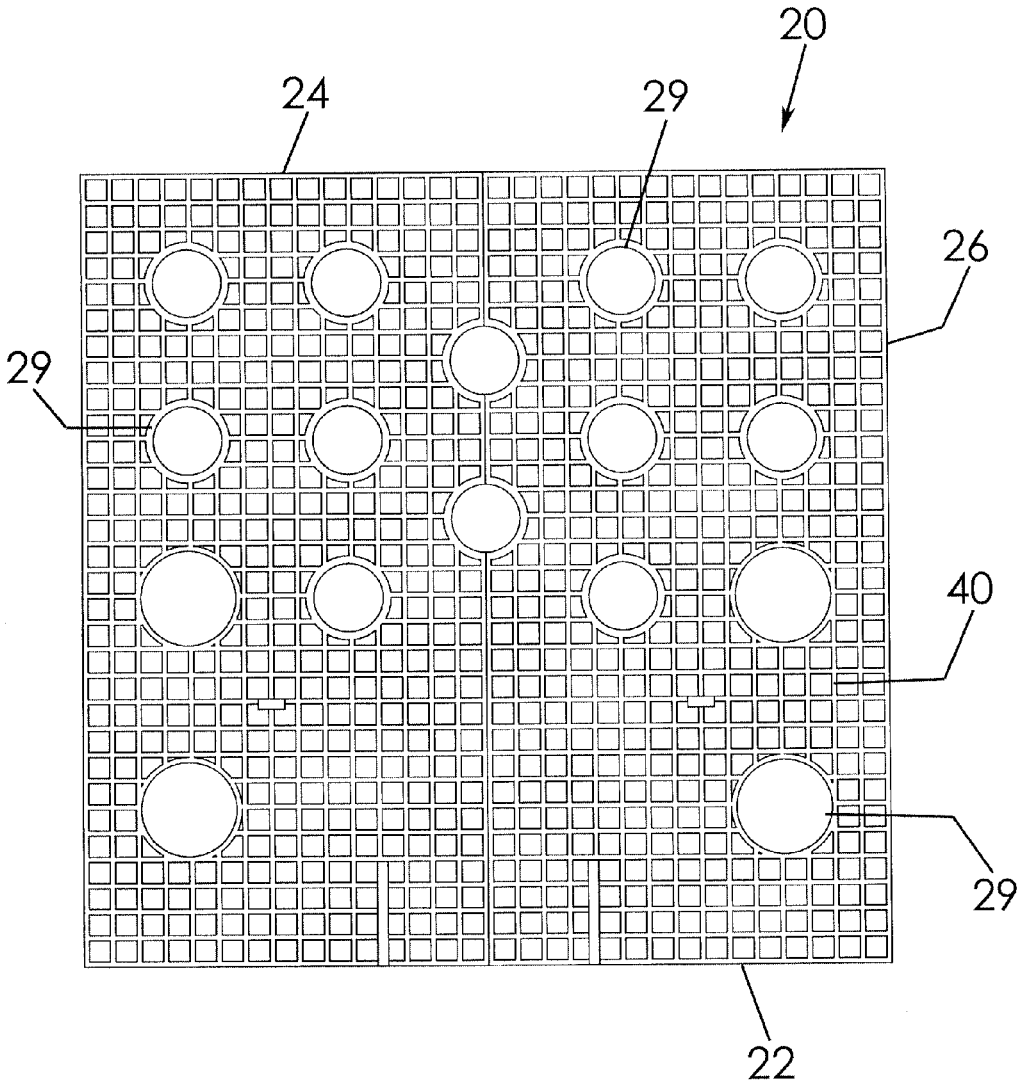
FIG. 4 is a top view of a first frame member removed from the apparatus shown in FIG. 1.
Figure 5:
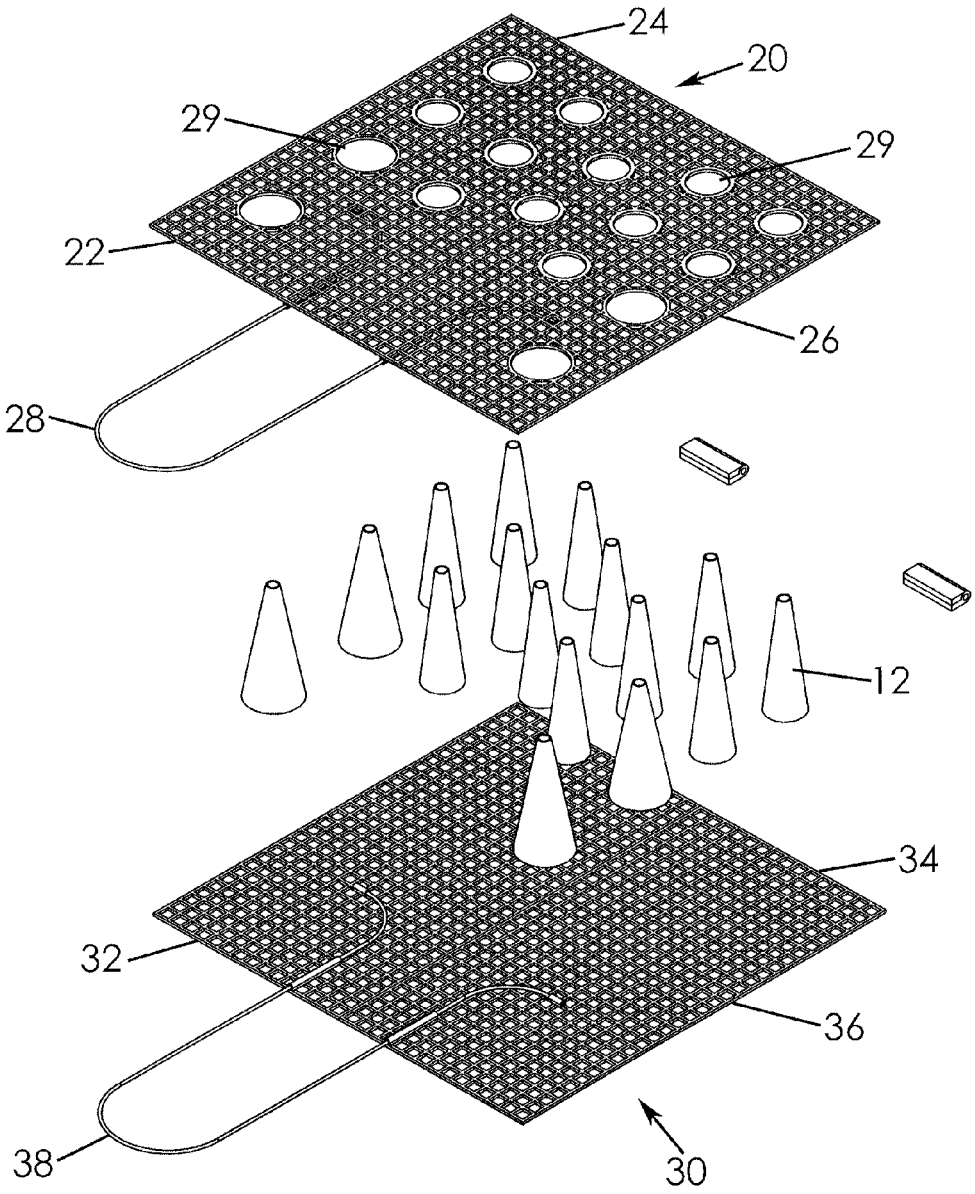
FIG. 5 is an exploded view of the cleaning apparatus as in FIG. 1.

A decorating tip cleaning apparatus for securing decorating tips for cleaning according to a preferred embodiment of the present invention will now be described with reference to FIGS. 1 to 3 of the accompany drawings.

The cleaning apparatus 10 includes a first frame member 20 having opposed front 22 and rear 24 edges. The first frame member 20 may also be referred to as a top frame member. Opposed side edges 26 may connect the first frame member front edge 22 to the first frame member rear edge 24. Similarly, the cleaning apparatus 10 includes a second frame member 30 having opposed front 32 and rear 34 edges. The second frame member 30 may also be referred to as a bottom frame member. Opposed side edges 36 may connect the second frame member front edge 32 to the second frame member rear edge 34. The second frame member rear edge 34 may be pivotally coupled to the first frame member rear edge 24 so that the frame members are movable between a closed configuration at which the front edges, respectively, are generally adjacent to one another (FIG. 1) and an open configuration (FIG. 2) at which the front edges, respectively, are separated from one another.

As shown in the drawings, the first and second frame members may have a generally square configuration although other shape configurations would also work. Each frame member also has a generally flat configuration such that the first 20 and second 30 frame members are generally parallel to one another at the closed configuration (FIG. 1).

The first 20 and second 30 frame members may include a mesh material 40. The mesh material 40 may be stretched between respective side edges or may be integrated into the actual construction of a respective frame member. The mesh material 40 has a traditional construction that includes a plurality of square-shaped openings configured to allow liquid to pass through, i.e. it is liquid permeable. The mesh material of only the first frame member 20 unexpectedly defines a plurality of generally circular apertures 29 spaced apart from one another and that are separate from the traditional openings of the mesh material. Each aperture 29 has a generally circular shape that is configured to partially receive a decorating tip therethrough as will be described further in detail later. Further, each aperture 29 has a diameter substantially larger than a dimension of any of the square shaped openings of the mesh material 40.

The cleaning apparatus 10 may include a first handle 28 coupled to the front edge 22 of the first frame member 20, the first handle 28 extending away from the front edge 22 (FIG.

2). Similarly, a second handle 38 is coupled to the front edge 32 of the second frame member 30 and extends away therefrom. Preferably, the first handle 28 and second handle 38 are aligned with one another when the first 20 and second 30 frame members are at the closed configuration (FIG. 1) so that both handles may be grasped with one hand.

With specific regard to the plurality of apertures 29 defined by the mesh material of the first frame member 20, at least one of the apertures 29 has a diameter that is larger than a diameter of at least one other of the apertures 29. With apertures of differing diameters, the first frame member 20 is configured to receive and hold securely decorating tips 12 of various sizes. Each aperture 29 is sized to receive a portion of a respective decorating tip 12 therethrough. In other words, a respective decorating tip 12 is not able to pass completely through an appropriate aperture 29 and fall out of the apparatus 10.

In use, the decorating tips cleaning apparatus 10 may be prepared to hold a plurality of tips 12 to be cleaned. Specifically, the first 20 and second 30 frame members may be moved to the open configuration (FIG. 2). Respective decorating tips 12 may be inserted through respective apertures 29 from the inside of the first frame member 20. Respective apertures 29 are configured to receive a substantial portion of each decorating tip 12 but such that the decorating tip 12 is prevented from passing entirely therethrough. As shown in FIG. 1, the decorating tips 12 protrude outwardly through the apertures 29 and away from the apparatus 10. After the decorating tips 12 have been "loaded" into the first frame member apertures 29, the frame members may be pivotally returned to the closed configuration (FIG. 1). At the closed configuration, the inserted decorating tips are essentially sandwiched between the frame members. The apparatus 10 may be lifted and held by the handles 28, 38 and sprayed with water, dipped into a wash basin, or positioned in a dishwasher whereby to clean the decorating tips. The cleaned decorating tips 12 may be removed by again pivotally moving the frame members to the open configuration.

It is understood that while certain forms of this invention have been illustrated and described, it is not limited thereto except insofar as such limitations are included in the following claims and allowable functional equivalents thereof.

The invention claimed is:

1. A decorating tip cleaning apparatus for securing decorating tips of a type having a generally conical configuration for cleaning, comprising:

a first frame member having opposed first front and first rear edges;

a second frame member having opposed second front and second rear edges, said first rear edge and said second rear edge being pivotally coupled together such that said first and said second frame members are movable between a closed configuration at which said first front edge and said second front edge are generally adjacent one another and an open configuration at which said first front edge and said second front edge, respectively, are separated from one another;

wherein:

said first and second frame members include a mesh material extending between respective front and rear edges, said mesh material including a plurality of square shaped openings configured to allow liquid to pass through;

said mesh material of said first frame member defines therein a plurality of generally circular shaped apertures spaced apart from one another and larger than each of said square shaped openings, each aperture being configured to receive a respective conical decorating tip partially therethrough.

2. The decorating tip cleaning apparatus as in claim 1, wherein said received decorating tips extend away from said first frame member when said first and second frame members are at said closed configuration.

3. The decorating tip cleaning apparatus as in claim 2, wherein:

said first frame member includes opposed first frame member side edges extending between said first frame member front and rear edges; and said second frame member includes opposed second frame member side edges extending between said second frame member front and rear edges.

4. The decorating tip cleaning apparatus as in claim 3, wherein said first frame member is parallel to said second frame member at said closed configuration.

5. The decorating tip cleaning apparatus as in claim 4, wherein said first frame member has a configuration substantially the same as a configuration of said second frame member.

6. The decorating tip cleaning apparatus as in claim 1, further comprising a first handle coupled to said front edge of said first frame member.

7. The decorating tip cleaning apparatus as in claim 6, further comprising a second handle coupled to said front edge of said second frame member.

8. The decorating tip cleaning apparatus as in claim 7, wherein said first handle is aligned with said second handle when said first and said second frame members are at said closed configuration.

9. The decorating tip cleaning apparatus as in claim 1, wherein at least one of said plurality of apertures of said first frame member has a diameter that is larger than a diameter of at least another of said plurality of apertures of said first frame member.

10. The decorating tip cleaning apparatus as in claim 1, wherein each of said plurality of apertures has a diameter configured to receive only a portion of a respective decorating tip therethrough.

11. The decorating tip cleaning apparatus as in claim 1 wherein said mesh material is permeable by liquid.

* * * * *